United States Patent [19]

Wenkman et al.

[11] Patent Number: 4,489,854

[45] Date of Patent: Dec. 25, 1984

[54] DISPENSING UNIT FOR ELONGATED ARTICLES

[75] Inventors: Gregory Wenkman, Middleton; Ferdinand Salzmann, Prairie du Sac, both of Wis.

[73] Assignee: Traex Corporation, Dane, Wis.

[21] Appl. No.: 401,553

[22] Filed: Jul. 26, 1982

[51] Int. Cl.[3] ..... B65H 3/62

[52] U.S. Cl. ..... 221/202; 221/197

[58] Field of Search ..... 221/202, 201, 200, 264, 221/203, 197, 143

[56] References Cited

U.S. PATENT DOCUMENTS 1,058,317 4/1913 McGill ..... 221/202
1,483,700 2/1924 Waple ..... 221/202
3,410,452 11/1968 Igel et al. ..... 221/197 X

FOREIGN PATENT DOCUMENTS 508427 6/1939 United Kingdom ..... 221/197

*Primary Examiner*—Stanley H. Tollberg
*Attorney, Agent, or Firm*—Isaksen, Lathrop, Esch, Hart & Clark

[57] ABSTRACT

A dispensing unit for elongated articles is disclosed in which the articles are packaged in a carton (62) which can be placed directly into the storage bin (12) of the dispensing unit (10). Articles fall out of the carton (62) onto a support shelf (64) upon which they roll toward the dispensing mechanism to dispense articles through a port formed in the front of the storage bin (12). The dispensing mechanism includes a pair of oscillating members (46) which have pickup fingers (52) formed on them so as to pick up one article and transfer it to the exterior of the storage bin (12) when handles (16) formed in the exterior of the storage bin (12) are operated by the user.

6 Claims, 6 Drawing Figures

Fig 3
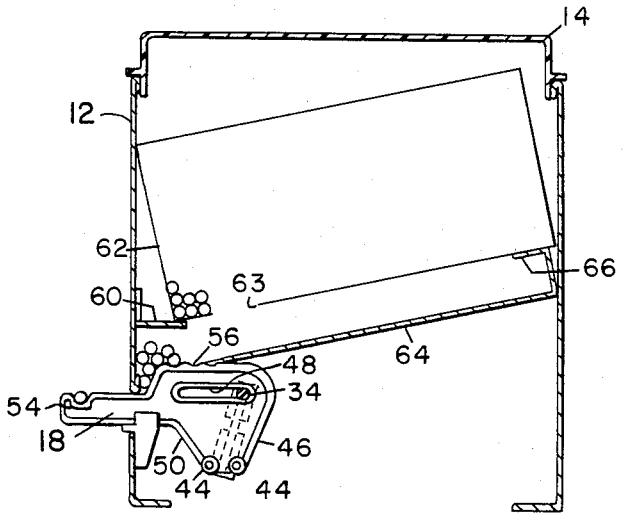
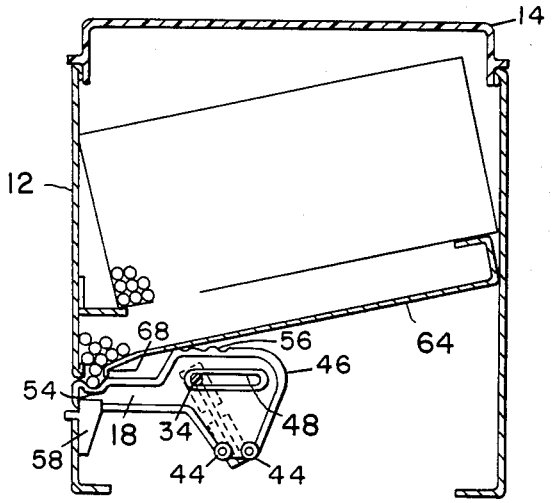
Fig 4
Fig 5
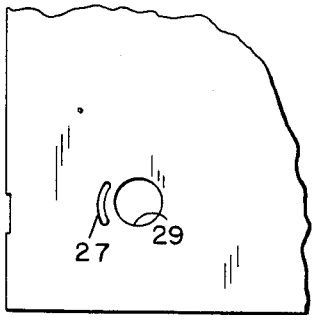
Fig 6
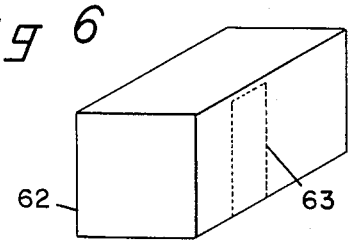

DISPENSING UNIT FOR ELONGATED ARTICLES

FIELD OF THE INVENTION

The present invention relates to dispensing units for dispensing single articles in general, and relates, in particular, to manually operable devices for dispensing elongated articles, such as soda straws, from a reservoir of such articles.

BACKGROUND OF THE INVENTION

The prior art is generally cognizant that receptacles can be constructed for dispensing elongated articles in which a tab or arm is depressed by the user so as to dispense a single elongated article, such as a drinking straw, match or cigarette. Often in the prior art dispensing devices of this type, a pivotably mounted member carries a single one of the articles from inside of the unit to outside of the unit through a rotational motion. One example of such an apparatus is shown in U.S. Pat. No. 1,008,867. Other similar examples can be seen in U.S. Pat. Nos. 592,105, 1,773,329, 2,664,330, 2,834,513 and 3,841,531. At least one example is known of a dispensing device which includes both a rotational member capable of selecting a single object from a reservoir and a member which oscillates to carry that selected member out to the user. A device of this type is illustrated in U.S. Pat. No. 2,752,065.

There are also some examples in the prior art of dispensing devices for such articles in which the mechanism delivering the article to the user oscillates into and out of the container of the reservoir of articles to select a single article from the reservoir and deliver it to the user. Examples of devices utilizing this general approach may be seen in U.S. Pat. Nos. 1,678,355 and 2,916,187. Other known prior art dispensing devices for such articles include U.S. Pat. Nos. 1,229,982 and 1,676,109.

It is a concern in the prior art and a general problem in the construction of such dispensing devices that care must be taken to minimize any jamming problem which may occur so as to prevent the dispensing of an article from the container. It has been found that the jostling of articles within the container facilitates the articles resting in an arrangement which minimizes the possibility of jamming when a dispensing activity occurs. In at least one example known in the prior art, that of U.S. Pat. No. 4,219,130, of a teaching in which the dispensing device includes particular means for jostling the articles contained in the dispensing device so as to help minimize the possibility of jamming during the dispensing operation.

SUMMARY OF THE INVENTION

The present invention is summarized in that a dispensing unit for elongated articles includes: a rectangular bin within which the articles to be received will be stored, the bin including a dispensing port formed in the front thereof; a suppport shelf fixed inside of the storage bin sloped angle so as to bias articles placed thereon to roll toward the dispensing port; at least one handle on the exterior of the bin operable by hand to cause the dispensing of one of the articles; a lever operator rotated by the operation of the handle; at least one oscillating member entrained on the lever bar and operable by the rotation of the lever bar to be oscillated forwardly and backwardly by said rotation of the lever bar; and a pickup finger extending forwardly from the oscillating member, the pickup finger having an article receiving recess formed in it, the pick up finger moving into and out of the bin through the dispensing port so that it picks up a single one of the articles to be dispensed when inside of the bin and delivers that article to the user's hand on the outside of the bin.

It is an object of the present invention to construct a dispensing unit for elongated cylindrical objects which quickly and accurately, with a minimum possibility of jamming, delivers one of the articles to the user.

It is another object of the present invention to provide a dispensing unit for elongated cylindrical articles in which the unit can be loaded and the articles dispensed without the necessity for human hands to touch the articles either to load the unit or to dispense the articles.

It is yet another object of the present invention to provide such a dispensing unit which is both efficient in its operation and economical to manufacture.

Yet other objects, advantages, and features of the present invention will become apparent from the following specification when taken in conjunction with the accompanying drawings.

BRIEF DESCRIPTION OF THE DRAWINGS

FIG. 3 is a cross-sectional view taken along the line 3—3 in FIG. 1 illustrating the mechanism at a point in which the pickup finger is outside of the bin.

FIG. 4 is a cross-sectional view taken along the line 3—3 in FIG. 1 showing the mechanism at a point in which the pickup finger is inside of the bin.

FIG. 5 is an elevational side view of a small portion of the side of the cabinet of the dispensing unit of FIG. 1 with the handle removed to show the location and orientation of the apertures formed therein.

FIG. 6 is a perspective view of a carton for the articles which is adapted for use with the dispensing unit of the present invention.

DESCRIPTION OF THE PREFERRED EMBODIMENT

Figure 1:
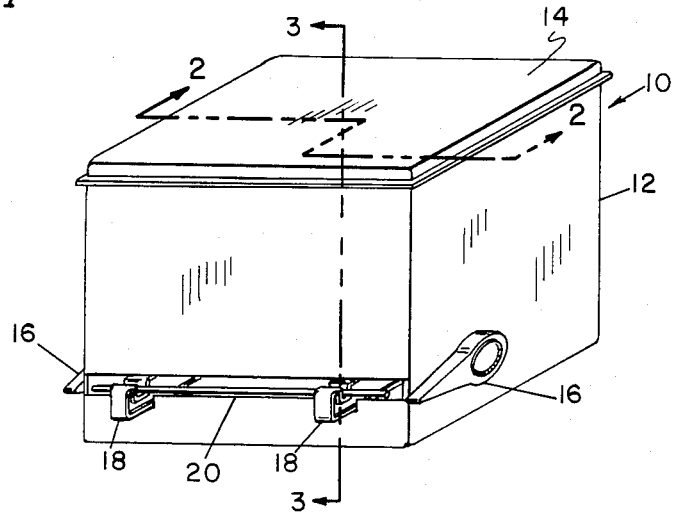
FIG. 1 is a perspective view of a dispensing unit constructed in accordance with the present invention.

Shown in FIG. 1, and generally illustrated at 10, is a dispensing unit constructed in accordance with the present invention. As can be seen in the perspective view of FIG. 1, the largest portion of the dispensing unit 10 is made up by a storage bin 12 which consists of a rectangular container formed of sheet metal, plastic or other similar rigid material. The storage bin 12 has an open top which is closed by a cover 14 which is removable so that access can be had to the interior of the storage bin 12. On each side of the storage bin 12 one of a respective pair of handles 16 is located. Each of the handles 16 is adapted to being operated by the hand of the user. When the handles 16 are depressed, a pair of pick up fingers 18 move into and out of a dispensing port 20, which is an opening formed in the front of the storage bin 12. When the pick up fingers retreat into the interior of the storage bin 12, the pick up fingers receive a straw, which they then offer to the user when the pick up fingers 18 are returned to the exterior of the storage bin 12.

Figure 2:
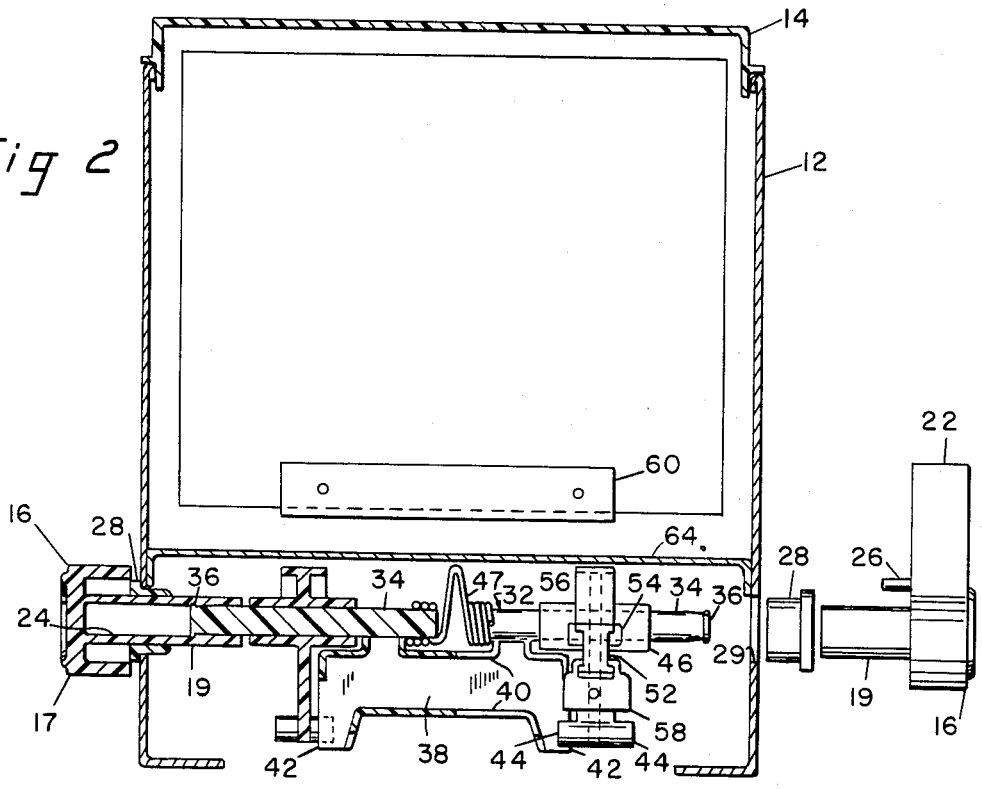
FIG. 2 is a cross-sectional view taken along the line 2—2 in FIG. 1.

As shown in detail in FIGS. 2 to 5 are the internal mechanics of the dispensing unit 10 of FIG. 1 which illustrate the general arrangement of parts and functioning of the dispensing mechanism itself. As can be seen in FIG. 2, which is a cross-sectional view taken along the line 2—2 in FIG. 1, each of the handles 16, located on opposite sides of the storage bin 12, includes a head portion 17 located on the exterior of the storage bin 12 and an inwardly extending shaft 19 formed extending from the head portion 17 into the inside of the storage bin 12 through a hole 29 formed in the side of the storage bin 12. Formed extending out to one side from the head portion 17 is a lever arm 22, which is entirely on the outside of the storage bin 12, and which provides a manually operable surface for pivoting the handles 16. The shaft 19, which extends into the interior of the storage bin 12, includes a longitudinally extending bore 24 centrally formed therein. A retaining pin 26 extends parallel to the shaft 19 from the underside of the head portion 17 of the handle 16 for a small distance. The retain pin 26 is received in a retaining pin slot 27, shown in FIG. 5, which is an arcuate slot formed in the side of the storage bin 12. The shaft 19 is received through the center of a bushing 28 which is inserted into the hole 29 provided in the side of the storage bin 12. The bushing 28 is sized so that it fills the hole 29 in the storage bin 12 and allows the shaft 19 of the handle 16 to be received therethrough and to be freely rotatable relative to the fixed bushing 28.

The handles 16 are each secured to one of the two ends of an elongated lever operator 32. The lever operator 32 includes a pair of separate colinear cylindrical shafts 34 which have a small gap between their inner ends and each of which has a retaining rib 36 formed on it near its outer end. Attached to each of the shafts 34 is a single downwardly depending bridge portion 38 which bridges between and joins together in a rigid fashion the two shafts 34. The bridge portion 38 is a large web of material extending between the shafts 34 and which is provided throughout most of its periphery with a stiffening peripheral rib 40 to give it rigidity. The peripheral rib 40 does not extend around the complete peripheral edge of the bridging member 40, but is absent from a pair of cam portions 42 located along the lower edge of the opposite ends of the bridging portion 38. Each of the cam portions 42 is received between a pair of pegs 44 which project outwardly from each side of the bottom edge of respective oscillating members 46. Each of the two oscillating members 46, one of which may be viewed in cross-section FIGS. 3 and 4, includes an elongated shaft slot 48 formed in it through which one of the shafts 34 extends. A downwardly extending portion of the oscillating member 46 has formed on it the pegs 44, two of which are located at the bottom of each of the oscillating members 46 with the pegs 44 extending outwardly from both sides of the bottom thereof. Each of the oscillating members 46 is preferably formed as a web of plastic material having a peripheral thickened rib 50 formed around its peripheral edge, except between the pegs 44, to give the oscillating member 46 great rigidity while still having light weight. The pickup finger 18 extends forwardly from each oscillating member 46 in a linear projection. Formed in each of the pickup fingers 18 is an article receiving recess 54 sized and shaped to correspond in its convexity to the general shape of the article to be dispensed by the dispensing unit 10. Along its upper surface, the oscillating member 46 is provided with a ribbed contour 56, formed as a scalloped portion on the upper peripheral edge of the oscillating member 46. Mounted on the interior of the front wall of the storage bin 12 are a pair of pickup finger guides 58 each located just under the dispensing port 20 provided in the front wall of the bin 12. Each of the pickup finger guides 58 is firmly fixed to the interior of the front wall of the storage bin 12 by a rivet or other fastener. Each pickup finger guide 58 includes a guide portion formed at the top thereof which is sized and shaped so as to coact with the peripheral rib 50 on the bottom of the pickup finger 18 to restrain the pickup finger 52 from lateral movement but allow the pickup finger 52 to move forwardly or backwardly without inhibition. A spring 47 is placed over the inner ends of the two shafts 34 of the lever operator 32 to bias the lever operator 32 to rotate in one direction. Mounted on the inside of the storage bin 12, also on the front wall, is a front box support bracket 60, which is formed as an angled piece of metallic stock sized and shaped so as to support one end of a paperboard carton 62 located inside of the storage bin 12 as can be seen in FIGS. 3 and 4. The support bracket 60 may also be omitted, with the front end of the carton 62 then resting on the inside of the front wall of the storage bin 12. A support shelf 64 is also located inside of the storage bin 12 and includes at its rear end a rear support bracket 66 sized and positioned so as to support the opposite end of the box 62 inside of the storage bin 12. A dispensing opening 63 of the carton 62 opens downwardly toward the support shelf 64. At its front end, the support shelf includes a front end 68 spaced adjacent from the inward edge of the interior of the front wall of the storage bin 12 by space sufficient to allow one, but not two, of the objects in the storage bin 12 to pass therethrough. The support shelf 64 has suitable recesses formed in it so as to allow the passage of the oscillating members 46 through the openings in it when the oscillating member is at the forwardly extent of its travel as indicated in FIG. 4.

The dispensing unit 10 of FIGS. 1 through 5 is particularly adapted for use with the paperboard carton 62 illustrated in FIGS. 3 and 4. The carton 62 is also illustrated in FIG. 6 which illustrates how this rectangular container includes a scoreline cut in one longitudinal side thereof so as to define a removeable tab covering the dispensing opening 63. The storage bin 12 of the dispensing unit 10 is preferably sized and shaped so as to receive the entire container 62 therein.

In its operation, the dispensing unit 10 of FIGS. 1 through 5 is particularly adapted for dispensing longitudinally extended cylindrical objects one at a time from a reservoir contained inside of the container 62 received in turn inside of the storage bin 12. The dispensing unit 10 is particularly advantageous in that the container 62 can be placed directly inside of the storage bin 12 without the need for unloading the objects therefrom so that the dispensing unit 10 can be loaded with the objects to be dispensed without the need for manually handling the objects. To load the dispensing unit 10, a full carton 62 of objects to be dispensed, such as soda straws, is taken from storage and the removable tab covering the dispensing opening 63 is removed to thereby allow the objects to fall out of the dispensing opening 64 if the carton is turned in the correct orientation. Then the cover 14 is removed from the dispensing unit 10 and the unit 10 is lowered upside down over the carton 62 of straws. After the unit 10 is turned rightside up carrying the carton 62 with it, the cover 14 can then be replaced.

As the carton 62 is placed inside of the dispensing unit 10, and as it remains in there thereafter, objects can fall out of the carton 62 through the dispensing opening 63 onto the support shelf 64. The slope of the support shelf 64 biases the cylindrical objects so that they roll toward the dispensing port 20 in the storage bin 12. Thus an accumulated supply of the articles accumulates at the front end of the support shelf 64 from which they are dispensed one at a time by the dispensing mechanism, which consists, in essence, of the moving parts of the dispensing unit 10 as will be described below.

To cause a single article to be dispensed from the accumulated supply of articles on the support shelf 64, the user presses one of the handles 16. The user depresses the lever 22 provided on the handle 16 by pressing downwardly thereon. The limit of travel of the handle 16 is defined by the retaining pin 26 which extends into the retaining pin slot 27 formed in the side of the storage bin. This limit in the rotational travel of the handle 16 also is the limit on the travel of the remaining parts of the apparatus which are moved by operation of the handle 16.

Rotational movement of the handle 16 is tranferred to the lever operator 34 since the retaining ribs 36 formed at opposite ends of the lever operator 32 are firmly received in the bores 24 of the handle 16. The rotational movement of the lever operator 32 causes the downwardly depending bridge portion 38 to swing forwardly and backwardly, as illustrated in dashed lines in FIGS. 3 and 4. The cam portions 42 formed at each edge of the bridge portion 38 are received between respective pairs of retaining pins 44 formed on the bottom of each of the oscillating members 46. As the bridge member 36 swings rearwardly, the oscillating member 46 is forced rearwardly as can be seen in FIG. 4. The oscillating member 46 is retained in its vertical orientation by the fact that the slot 48 in the oscillating member 46 is entrained over the shaft 34 of the lever operator 32. The oscillating member 46 is retained from side to side lateral movement by the pickup finger restraining guide 58. When the oscillating member 46 is at the rearwardly extent of its travel, as shown in FIG. 4, one of the articles falls into the article receiving recess 54 formed in the pickup finger 18.

When the user then removes his finger from the handle 16 the spring 47 causes the lever operator 32 to pivot back to its original orientation. This causes the cam operators 42 at the bottom of the lever operators 32 to move the oscillating members 46 to their forward most positions as illustrated in FIG. 3. As the oscillating members 46 move forwardly, the pickup fingers 18 carry one of the articles out of the storage bin 12 in the article receiving recess 54 formed in the front end of each of the pickup fingers 18. Since the article receiving recess 54 is sized so as to receive one, and only one, of the articles, a single one of the articles is transferred from the storage bin and offered to the user with each depression of the handles 16.

It is important in a dispensing unit for elongated articles that any jamming of the articles be avoided to the fullest extent possible. Often as a collection of articles is narrowed down to a single article to be dispensed, jamming or bridging can occur. For example, as can be seen in FIG. 4, where many of the articles are positioned on the support shelf 64 and are funneling down toward the opening formed between the front edge 68 of the support shelf in the inside wall of the storage bin 12 bridging of the articles can occur. Therefore, the oscillating members 46 have formed on their upward edges a ribbed contour 56. This ribbed contour engages the articles and jostles them as the oscillating member 46 moves forwardly. This effect is illustrated in FIG. 3. This jostling effect, which automatically occurs during each dispensing of an article from the dispensing unit 10, rearranges the articles after every dispensing operation to insure that bridging or jamming does not occur. In this way, the possibility of a dispensing operation occurring without an article being dispensed is minimized.

Thus the dispensing unit of the present invention is capable of being loaded with a full carton 62 of articles without the need for any of the articles to be touched by human hands during the loading operation. Thereafter, each pressing of the handles 16 of the dispensing unit 10 dispenses a single one, and only one, of the articles from the reservoir of articles held within it. With each dispensing of the articles, the articles awaiting to be dispensed are jostled automatically by the apparatus to minimize any jamming or bridging which may occur so as to interfere with subsequent dispensing operations. In this fashion, an inherently more reliable dispensing unit is described than was heretofore possible.

It is envisioned that the present invention is not limited to the particular embodiment disclosed and illustrated herein, but embraces all such modified forms thereof as come within the scope of the following claims.

We claim:

1. A dispensing unit for elongated articles comprising a rectangular storage bin (12) having a dispensing port (20) in the front thereof;

a support shelf (64) located in the storage bin (12) sloped so that articles placed thereon will roll toward the dispensing port (20);

at least one handle (16) on the exterior of the storage bin (12) operable by hand;

a pivotable lever operator (32) rotated by operation of the handle (16);

at least one oscillating member (46) including a pickup finger (18), the oscillating member (46) moving forwardly and backwardly as the lever operator (32) is rotated so that the pickup finger (18) moves into and out of the storage bin (12), the oscillating member (46) including a slot (48) formed in it through which the lever operator (32) extends so that the oscillating member (46) is entrained on the lever operator (32) to limit the movement of the oscillating member (46); and a pickup finger guide (18) mounted on the front of the storage bin (12) just under the dispensing port (20) for each oscillating member (46), the pickup finger guide (18) being shaped and sized so as to retain therein the pickup finger (52) of the respective oscillating member (46) so as to confine the motion of the pickup finger (18) to the forward and backward motion of the oscillating member (46).

2. A dispensing unit for elongating articles comprising a rectangular storage bin (12) having a dispensing port (20) in the front thereof;

a support shelf (64) located in the storage bin (12) sloped so that articles placed thereon will roll toward the dispensing port (20);

at least one handle (16) on the exterior of the storage bin (12) operable by hand;

a pivotable lever operator (32) rotated by operation of the handle (16);

at least one oscillating member (46) including a pickup finger (18), the oscillating member (46) moving forwardly and backwardly as the lever operator (32) is rotated so that the pickup finger (18) moves into and out of the storage bin (12), the oscillating member (46) including a slot (48) formed in it through which the lever operator (32) extends so that the oscillating member (46) is entrained on the lever operator (32) to limit the movement of the oscillating member (46); and the lever operator (32) including a downwardly depending bridge portion (38) which includes a cam portion (42) for each oscillating member (46), the cam portion (42) of the lever operator (32) engaging a portion of each of the oscillating members (46) to cause the forward and backward movement of the oscillating member as the lever operator (32) is rotated.

3. A dispensing unit for elongated articles as claimed in claim 2 wherein each of the oscillating members (46) includes a pair of outwardly extending pegs (44) which are positioned on opposite sides of the cam portion (42) of the lever operator (32) so that motion of the cam portion (42) of the lever operator (32) is transferred through the pegs (44) to the oscillating member (46).

4. A dispensing unit for elongated articles which are packaged in a rectangular paperboard carton (62) having a dispensing opening (63) formed in one side of it, the dispensing unit comprising a rectangular storage bin (12) sized so as to be capable of receiving the entire carton (62) of articles therein and having a dispensing port (20) formed in the front thereof;

a support shelf (64) located in the storage bin sloped so that articles placed thereon will tend to roll toward the dispensing port (20);

a dispensing means located adjacent the dispensing port (20) for selectively dispensing one article at a time out of the storage bin from those which roll down the support shelf (64), the dispensing means including a pair of oscillating members (46), each of which include a pickup finger (18) thereon, the oscillating members (46) moving forwardly and rearwardly so as to move the pickup fingers (18) into and out of the dispensing port (20) to carry articles out of the storage bin (12);

a support bracket (66) located in the rear of the storage bin (12) so as to support the carton (62) of articles in the storage bin (12) in spaced relation above the support shelf (64) so that articles which fall out of the dispensing opening (63) in the carton (62) can fall onto the support shelf (64) to roll along it;

a pair of handles located on the exterior of the storage bin (12); and a lever operator (32) attached to said handles (16) and rotatable thereby, the lever operator (32) being connected to the oscillating members (46) to move the oscillating members when the handles (16) are rotated.

5. A dispensing unit for elongated articles as claimed in claim 4 wherein each of the pickup fingers (18) includes an article receiving recess (54) formed therein, the article receiving recess (54) sized and shaped so as to receive a single one of the articles therein, the articles receiving recess (54) receiving one, and only one, article as the pickup finger moves into the storage bin (12) and carries that single article out of the storage bin (12) when the oscillating member (46) moves forwardly.

6. A dispensing unit for elongated articles comprising a rectangular storage bin (12) having a dispensing port (20) in the front thereof;

a support shelf (64) located in the storage bin (12) sloped so that articles placed thereon will roll toward the dispensing port (20);

a pair of oscillating members (46) located inside of the storage bin (12) and moveable forwardly and backwardly in an oscillating fashion;

a pickup finger (18) located on each of the oscillating members (46) at a range so that the pickup fingers (18) move into and out of the storage bin (12) as the oscillating member (46) moves forwardly and backwardly;

a pivotable lever operator (32) extending through each of oscillating members (46) such that rotation of the lever operator (32) causes forward and backward movement of the oscillating members (46);

a spring (46) engaging the lever operator (32) to bias its movement in one direction; and a pair of handles (16) located on opposite sides of the exterior of the storage bin (12) and connected to the lever operator (32), each of the handles (16) including a retaining pin (26) which extends into a retaining pin slot (27) formed on the side of the storage bin (12) so that the rotational movement of the handles (16) is limited by the length of the retaining pin slot (27).

* * * * *